United States Patent [19]

Marazzini

[11] Patent Number: 4,542,548

[45] Date of Patent: Sep. 24, 1985

[54] METHOD TO FORM SOLES WITH A HEEL AND AN UNDER-HEEL, MAINLY FOR WOMEN FOOTWEAR, WITH AN INCORPORATED SUPPORTING CORE, OR REINFORCEMENT, AND SHAPED AND REINFORCED SOLES OBTAINED BY SAID METHOD

[75] Inventor: Severino Marazzini, Vigevano, Italy

[73] Assignee: PAMA S.p.A., Vigevano, Italy

[21] Appl. No.: 475,319

[22] Filed: Mar. 14, 1983

[30] Foreign Application Priority Data

Mar. 17, 1982 [IT] Italy ..... 20228 A/82

[51] Int. Cl.[4] ..... A43B 13/28; A43B 13/37; A43B 21/36

[52] U.S. Cl. ..... 12/142 J; 12/147 R; 36/24.5; 264/244; 425/129 S

[58] Field of Search ..... 36/24.5, 30 A, 35 A; 264/244; 12/142 J, 147 R, 147 A; 425/119, 129 S

[56] References Cited

U.S. PATENT DOCUMENTS

| | | | |
|---|---|---|---|
| 3,119,192 | 1/1964 | Ronci | 36/34 A |
| 3,178,835 | 4/1965 | Burke et al. | 36/34 A |
| 4,224,748 | 9/1980 | Whitchurch | 36/24.5 |
| 4,244,070 | 1/1981 | Ughi | 12/142 J |
| 4,272,897 | 6/1981 | Ponce | 36/24.5 |
| 4,403,426 | 9/1983 | Kaplan | 36/360 |

FOREIGN PATENT DOCUMENTS

| | | | |
|---|---|---|---|
| 2949149 | 6/1980 | Fed. Rep. of Germany | 36/24.5 |
| 2400857 | 4/1979 | France | 36/24.5 |

*Primary Examiner*—Werner H. Schroeder
*Assistant Examiner*—Steven N. Meyers
*Attorney, Agent, or Firm*—Abelman, Frayne, Rezac & Schwab

[57] ABSTRACT

An integral sole and heel construction for footwear having a wear resistent under-heel is formed by molding a fluid pre-polymeric compound using the under-heel as a piston to displace the fluid compound at least in part through channels formed in the under-heel.

2 Claims, 8 Drawing Figures

METHOD TO FORM SOLES WITH A HEEL AND AN UNDER-HEEL, MAINLY FOR WOMEN FOOTWEAR, WITH AN INCORPORATED SUPPORTING CORE, OR REINFORCEMENT, AND SHAPED AND REINFORCED SOLES OBTAINED BY SAID METHOD

FIELD OF THE INVENTION

This invention relates to a method of forming an integral sole and heel, with a built-in supporting core or stem, and a wear resistant under-heel, mainly for women's footwear.

This invention also relates to the product obtained by said method, namely shaped and reinforced soles for footwear.

This invention also includes the assembly to be integrated into the finished product, and, more specifically a composite structure arranged to be encapsulated in a shaped mass of polymeric material.

BACKGROUND OF THE INVENTION

This invention relates to the technique of the industrial preforming parts of footwear, particularly of women's footwear, generally having a high and tapered heel, and also a shaped and arched sole. This product is intended to be joined to a complete or partial upper made of an elastic polymeric material, such as polyvinyl or preferably polyurethane polymer. Said product includes the sole and the heel, provided with a preferably but not necessarily replaceaable under-heel as a wear resistant element. Such a wear resistent under-heel cannot be formed integrally with the shaped polymeric solidified element.

THE PRIOR ART

It is known to form the polymeric element by molding a pre-polymeric material in a fluid state in a mold cavity, whose shape circumscribes completely the element to be obtained, including the under-heel. It is not possible to make a product integral with an under-heel, because of insuperable difficulties in the manufacture of the solidified element. The presence of said previously positioned under-heel hinders and makes difficult the complete filling or saturation of the mold cavity with the pre-polymeric fluid material, in which the various components must be immersed to be enveloped perfectly in the finally solidified mass.

THE INVENTION

Essentially, this invention is aimed at solving the technical and production problems that at the present time prevent or at least make it very difficult to consistently obtain a faultless and consequently marketable item.

The main difficulties encountered are due to the fact that the under-heel must be previously positioned and connected (in a generally known way) to a composite structure which includes at least a core of the tapered heel and a stiffening element for the arched load-bearing portion of the sole. This obstructs the flow and the rising of the fluid material within the mold cavity for a complete filling of the mold cavity to the higher level of the sole.

In the main step in the production cycle, said composite structure is guided into the mold cavity, into which catalyzed or uncatalyzed polymeric material has been previously admitted. During this movement, the under-heel intercepts the smaller transverse section of said cavity, and prevents the homogeneous completion of the rising of the fluid material to the aforesaid level.

Essentially, the method according to this invention is characterized by a particular sequence of steps and operative conditions, specifically the steps of:

(a) admitting a pre-polymeric compound in a fluid state into the mold cavity;

(b) prearranging a tridimensionally shaped element including the core or reinforcement of the heel and a stiffening and/or supporting element of the shoe instep;

(c) positionally joining an under-heel to said core, in such a way as to prearrange the core of the heel, said under-heel, and said stiffening and/or supporting element; and, (d) directionally guiding and positioning the composite structure into the fluid pre-polymeric compound in said mold cavity, to cause the pre-polymeric fluid material to rise around said composite structure and reach a level high enough to form the sole.

The method is further characterized in that said under-heel is tridimensionally shaped in such a way as to allow the fluid material rising as per step (d) to pass through said under-heel to secure it in place upon curing of the polymeric material, and more specifically it is characterized in that said under-heel is provided with holes through which the fluid compound is allowed to rise for it to entirely fill the surrounding mold cavity, thus integrating said under-heel into the body of the finished heel, and moreover is characterized in that the contour of said under-heel is smaller than the corresponding section of the mold cavity, so that fluid compound rising as per step (d) will pass around said under-heel, completing said integration of the heel into said body.

The method according to the present invention is preferably characterized in that said under-heel, positioned as per step (c) is connected in a replaceable way to the heel of the finished sole.

DESCRIPTION OF THE DRAWINGS

The aforesaid and other more specific features of the invention will be apparent from a reading of the following detailed description, given with reference to the accompanying drawings, in which.

DETAILED DESCRIPTION

Figure 3:
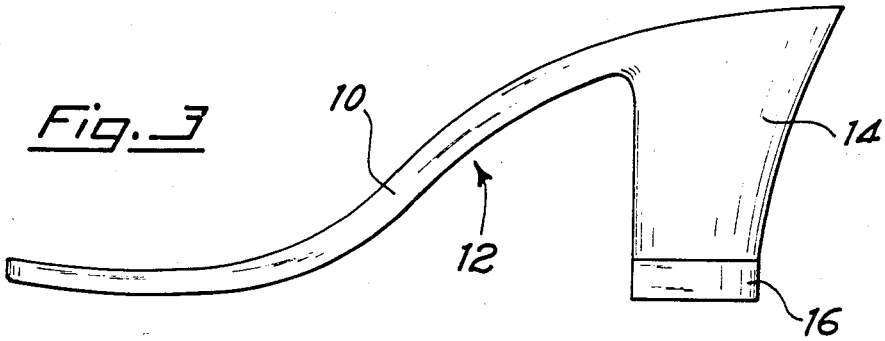
FIG. 3 shows, in a side view, the finished, marketable product when removed from the mold.

With reference to the aforesaid drawings, the finished product is shown in FIG. 3, and includes a traditionally shaped and arched sole 10, with a load-bearing concavity 12, and a "high" and tapered heel 14. According to the invention, the heel 14 is provided with a under-heel 16 joined with said parts 10 and 14, into an essentially homogeneous and faultless body, i.e., without air bubbles or the like. This under-heel may be of different forms, such as those shown in FIGS. 5 and 6.

Figure 1:
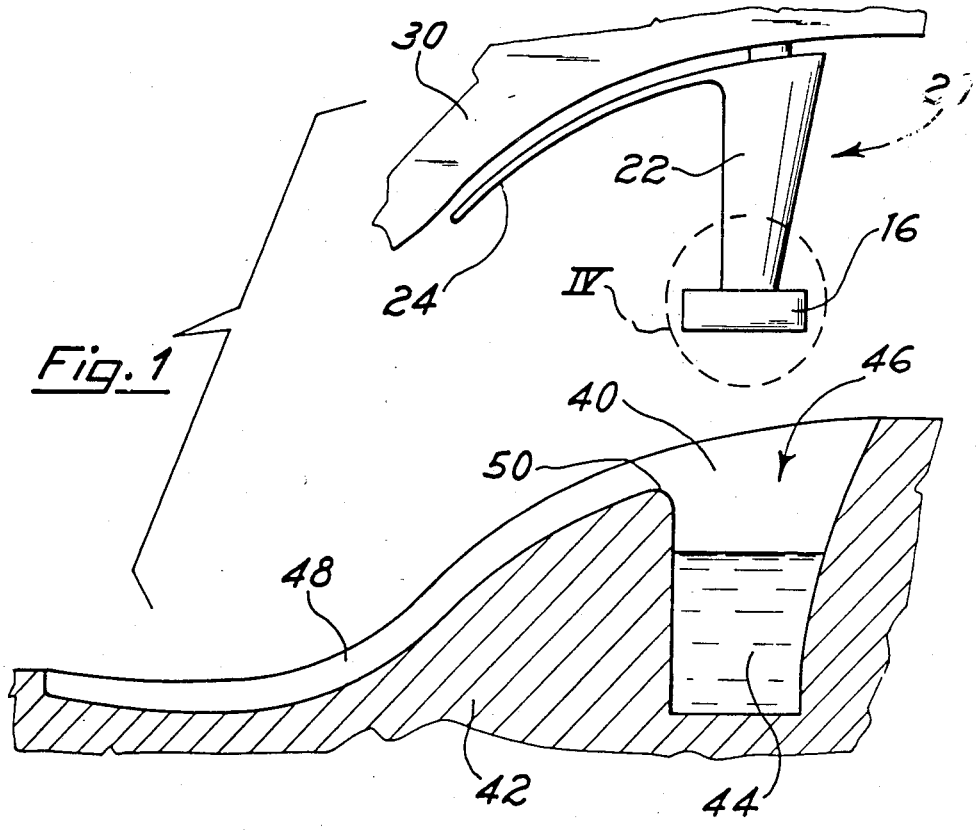
FIG. 1 is a side view partially in cross-section through the sagittal plane of the sole, showing an assembled element carried under a top mold, and which is to be positionally guided into a mold cavity containing a measured amount of fluid pre-polymeric material.

Referring to FIG. 1, the manufacturing cycle includes the directionally guided positioning (in a known way) of a composite structure 20 under the mold 30, the structure 20 including an element 22, which may be properly defined as the "core" of the heel 14, and an arched reinforcement element 24, generally metallic, having the same profile of the bent portion 12 of the sole, and, according to the invention, the under-heel 16.

Figure 4:
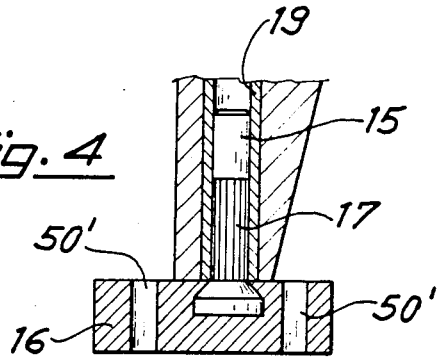
FIG. 4 shows, in a sectional view on an enlarged scale, details of the portion of FIG. 1 contained in the circle IV.

The under-heel is positioned and fixed to the element 22 by means of a rod-shaped element 15 with a knurling 17 (FIG. 4). Said fixing is carried out forcing the rod-shaped element 15 into a small metallic tube 19 prepositioned in the portion 22 of the structure 20 and generally coincident with the axis of the heel.

The top mold 30 is lowered in a guided way towards and into the cavity 40 of a mold 42, into which has been previously admitted a given amount 44 of pre-polymeric fluid compound, which may or not have been previously catalyzed and accellerated. The higher portion 48 of said cavity will form the sole 10, due to the overflow of the fluid material 44 over the edge 50 at the higher level of cavity 40.

Advantage is taken of well-known expansion and settling phenomena to obtain (FIG. 3) a homogeneous and coherent product. The result of the lowering movement may be observed in FIG. 2, which shows the cavity of the mold 42 completely filled with the prepolymeric fluid material, which is then subjected to polymerization and subsequent solidification or condensation.

During the lowering movement, the under-heel 16 progressively enters the port provided by the section 46 of the mold cavity 40.

Figure 5:
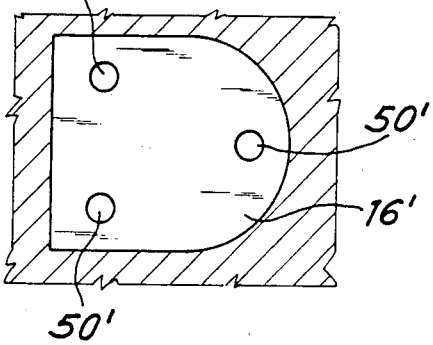
FIGS. 5 and 6 show different embodiments of the under-heel, positioned in the mold cavity and seen on the plane and the direction defined by the line V–VI of FIG. 2.
Figure 6:
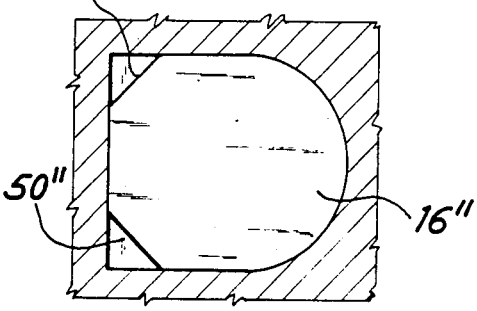

To remove any obstacle to the rising of the fluid compound within the mold cavity, (said rising being indicated by the arrows in FIG. 2) the under-heel 16 is provided with a number of through holes 50', as shown in FIG. 4 and in the under-heel 16 of FIG. 5, or alternatively discontinuities 50'' are provided in the contour of the under-heel 16'' as shwon in FIG. 6. This prevents the contour of the under-heel from completely occluding the transverse section 46, which progressively gets narrower as said under-heel moves towards the bottom of the cavity 40.

Consequently, the technical solutions applied in the different embodiments shown in FIGS. 4, 5 and 6 lead to the same result, i.e., to allow the fluid compound in the mold cavity for the forming of the heel 14, which is tapered and sometimes very slender, to rise and the mold become completely filled.

Figure 2:
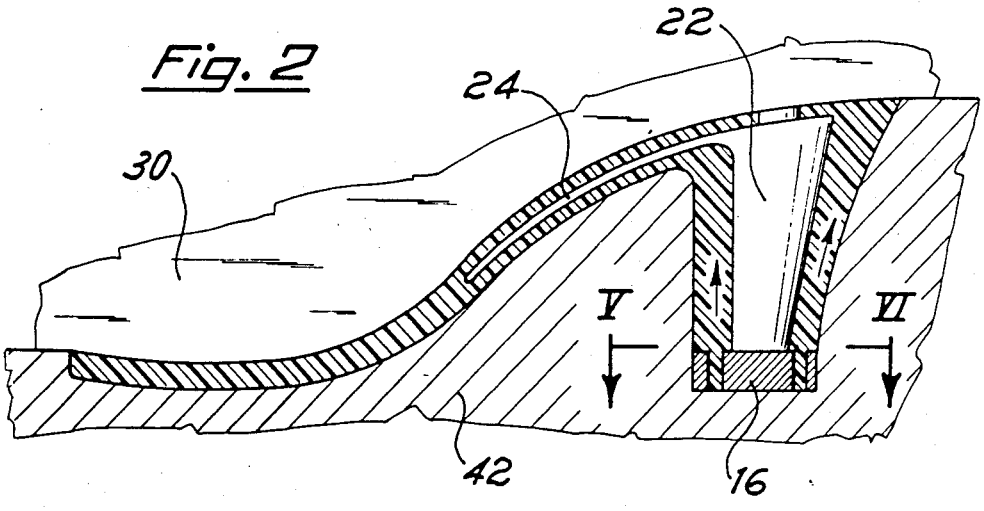
FIG. 2 is a similar view and section showing the finished product.

As is shown in FIG. 2, upon polymerization and subsequent solidification or condensation of the polymeric material, the under-heel 16 will become detachably secured to the heel by the plugs of polymerized material formed integrally with the heel and which extends into the holes 50' in the embodiments of FIGS. 4 and 5. This permits removal and replacement of the under-heel 16 when so required.

Figure 7:
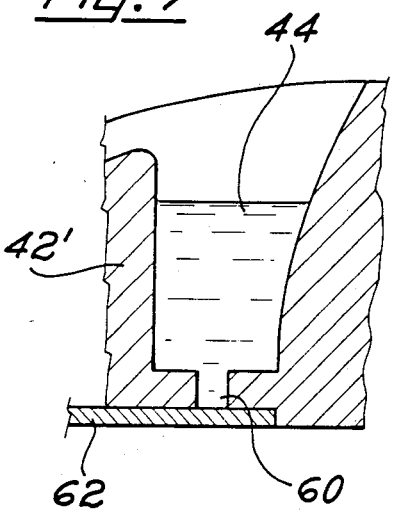
FIG. 7 shows an alternative mode for carrying out the method as shown in FIG. 1, and namely a device to eliminate the possible surplus of the pre-polymeric material, after the mold cavity has been completely filled; and, FIG. 8 shows the completion of the operation when using the aforesaid different method.
Figure 8:
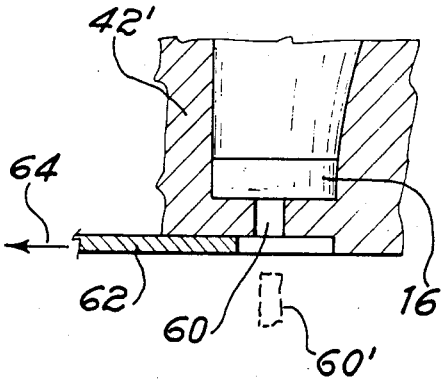

Should the shape of the under-heel be such as to prevent the fluid compound from completely rising in the upward direction, the mold 42' (FIGS. 7 and 8) may be provided with at least a lower draining hole 60, normally shut off by a slide or "chest" 62, (FIG. 7) and which, in the final stage of the immersion is moved in the direction 64 (FIG. 8). This allows the removal of the excess fluid material 60.

What I claim is:

1. A method of manufacturing a sole and heel construction for footwear by the use of a mold having sole and heel forming cavities, comprising the steps of:

inletting a determined quantity of a pre-polymerized fluid polymeric compound into said heel forming cavity;

preforming an assembly of a reinforcing member heel core and an under-heel attached to said heel-core, said under-heel having a peripheral contour substantially complementary to the cross-section of a terminal end of said heel cavity, and being of lateral dimensions greater than the cross-section of said heel core at the end thereof adjacent said under-heel, said under-heel having channels extending between its face proximate said heel core and the opposite face of said under-heel, said channels being located outwardly of the periphery of said heel core;

directionally guiding and positioning said assembly into said mold to insert said heel core and under-heel into said heel forming cavity and to insert said stiffener into said sole forming cavity;

employing said under-heel as a piston to displace said fluid compound, at least in part, through said channels in said under-heel and into filling relationship with said heel and sole forming cavities, and thus into encapsulating relationship with said stiffener, heel core and under-heel assembly; and, polymerizing said polymeric compound.

2. A method according to claim 1, including the step of evacuating excess fluid polymeric material from said mold through a selectively openable port in said terminal end face of said heel cavity.

* * * * *